United States Patent [19]

Shin

[11] 4,386,633

[45] Jun. 7, 1983

[54] WEFT RESERVOIR FOR AN ALTERNATE TWO-PICK CHANGE TYPE FLUID JET SHUTTLELESS LOOM

[75] Inventor: Tokujiro Shin, Matsutou, Japan

[73] Assignee: Tsudakoma Kogyo Kabushiki Kaisha, Japan

[21] Appl. No.: 161,679

[22] Filed: Jun. 23, 1980

[30] Foreign Application Priority Data

| | | | |
|---|---|---|---|
| Jun. 22, 1979 | [JP] | Japan | 54-079384 |
| Oct. 9, 1979 | [JP] | Japan | 54-131059 |
| Oct. 17, 1979 | [JP] | Japan | 54-134348 |
| Oct. 24, 1979 | [JP] | Japan | 54-138217 |

[51] Int. Cl.[3] ..... D03D 47/36

[52] U.S. Cl. ..... 139/452; 242/47.01; 242/47.08

[58] Field of Search ..... 139/452, 47.01; 242/47.08, 47.12

[56] References Cited

U.S. PATENT DOCUMENTS

| | | | |
|---|---|---|---|
| 3,280,853 | 10/1966 | Brown et al. | 139/452 |
| 3,411,547 | 11/1968 | Bucher | 139/452 |
| 3,670,976 | 6/1972 | Vischiani | 242/47.12 |
| 3,776,282 | 12/1973 | Sevcik et al. | 139/452 |

FOREIGN PATENT DOCUMENTS

| | | | |
|---|---|---|---|
| 469960 | 4/1975 | U.S.S.R. | 139/452 |

*Primary Examiner*—Henry Jaudon

*Attorney, Agent, or Firm*—Lerner, David, Littenberg, Krumholz & Mentlik

[57] ABSTRACT

A weft reservoir for a alternate two-pick change type fluid jet shuttleless loom includes a continuously rotating drum assembly for provisionally reserving a weft continuously supplied from a given source and a control pin arranged facing the drum assembly and driven, at a prescribed timing, for provisional engagement with the weft being unwound from the drum assembly, thereby causing the controlled delivery of weft during the terminal stage of each weft insertion. Stabilized quality of the products with reduced waste of weft is attained.

14 Claims, 18 Drawing Figures

Fig. 5H
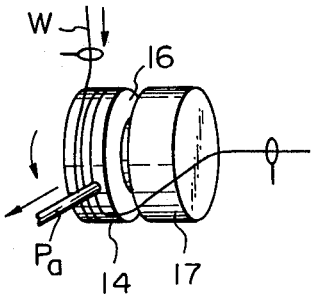
Fig. 5I
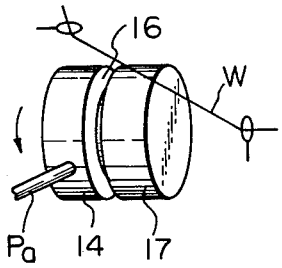
Fig. 6
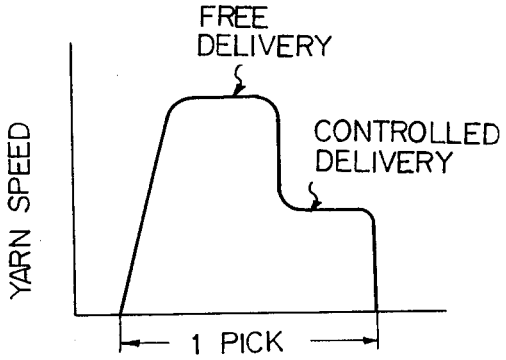
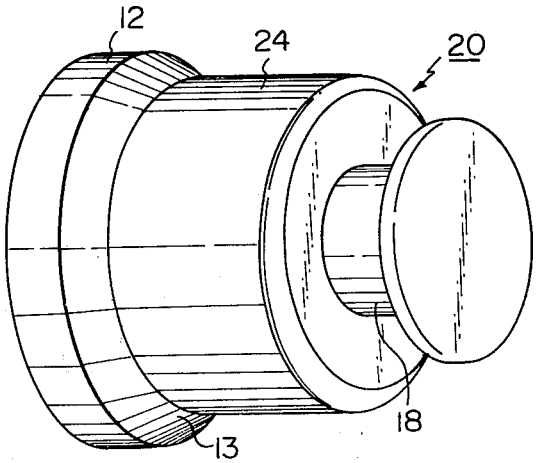
Fig. 7

WEFT RESERVOIR FOR AN ALTERNATE TWO-PICK CHANGE TYPE FLUID JET SHUTTLELESS LOOM

BACKGROUND OF THE INVENTION

The present invention relates weft reservoir for an alternate two-pick change type fluid jet shuttleless loom, and more particularly relates to weft reservoir in which a weft continuously supplied from a given source is provisionally reserved on a rotary drum or drums for subsequent delivery to a jet nozzle on an alternate two-pick change type fluid jet shuttleless loom such as an air jet loom wherein alternate two-pick change type weft insertions are carried out within four crank cycle.

Weft reservoirs of alternate two-pick change type are classified into two categories, the one using a weft reserving tube or tubes and the other using a weft reserving drum or drums.

From the viewpoint of weft supply, they are further classified into two categories, the one employing continuous weft supply and the other employing intermittent weft supply.

Some examples of the intermittent weft supply type weft reservoir are disclosed in Japanese Patent Publication No. 10692/64 and Utility Model Publication No. 8701/73. In the case of the weft reservoir of this type, slip of weft tends to occur when weft measuring is initiated for the first weft insertion. Excessive tension may be generated on the weft at this moment, also. Further, when weft measuring for the second weft insertion comes to end, supply of weft cannot be stopped at the correct moment due to inertia of the weft and its related part, thereby disabling correct control of the measured length of the weft. In order to avoid these troubles, it is advisable to employ the continuous weft supply system.

An example of the continuous weft supply type weft reservoir is disclosed in Japanese Utility Model No. 34306/73. In the case of weft reservoir of this type, the length of weft for about two picks reserved in a weft reserving tube at one time and delivered in two separate times for weft insertion. Consequently, the length of weft reserved in the tube before the first weft insertion is different from that before the second weft insertion, i.e. after the first weft insertion. This results in a large difference in resistance against weft delivery from the tube between the first and second weft insertions. This naturally leads to difference in weft tension which ill affects the quality of the products woven on the loom for which the weft reservoir is used. During the reservation within the tube, the weft is entrained on air flow whilst forming a U-shape. This relatively free condition of the weft during the reservation tends to form kinks and/or snarls on the weft in particular when the weft is a high twist yarn, which form weaving defects on the products woven. Use of strong air stream in the tube prevents formation of such kinks and snarls on the weft during its reservation. This, however, causes other troubles such as increased resistance against weft delivery, increased power consumption and formation of fluffs. In order to avoid the above-described drawbacks, it is advantageous to use a combination of weft reservation on a drum with continuous weft supply.

In the case of the continuous weft supply system combined with reservation on a drum, however, it is necessary to subject the weft to controlled delivery during the terminal stages of the first and second weft insertions in order to avoid variance in length of the inserted weft. In the case of the conventional weft reservoirs of weft reserving drum type, it has been technically impossible to practice such a control delivery of weft during the first difficult on a conventional weft reservoir to successfully combine the weft reserving drum system with the continuous weft supply system.

SUMMARY OF THE INVENTION

It is the basic object of the present invention to enable successful combination of the weft reserving drum system with the continuous weft supply system on a weft reservoir for an alternate two-pick change type fluid jet shutteless loom.

It is another object of the present invention to practice controlled delivery of weft from a weft reserving drum, to which the weft is continuously supplied, during the terminal stage of the first insertion on an alternate two-pick type fluid-jet shuttleless loom.

In accordance with the basic aspect of the invention, the weft is continuously supplied to a continuously rotating weft reserving drum assembly and a weft control pin is arranged facing the drum assembly in an arrangement such that the control pin is provisional registered, at a prescribed timing, at an operative position in order to be in engagement with the weft to be unwound from the drum assembly, thereby causing the controlled delivery of weft.

BRIEF DESCRIPTION OF THE DRAWINGS

FIG. 6 is a graph for showing the mode of weft delivery from the weft reservoir in accordance with the present invention, FIG. 7 is a perspective view of the weft reserving drum used for the second embodiment of the weft reservoir in accordance with the present invention.

DESCRIPTION OF THE PREFERRED EMBODIMENTS

Figure 1:
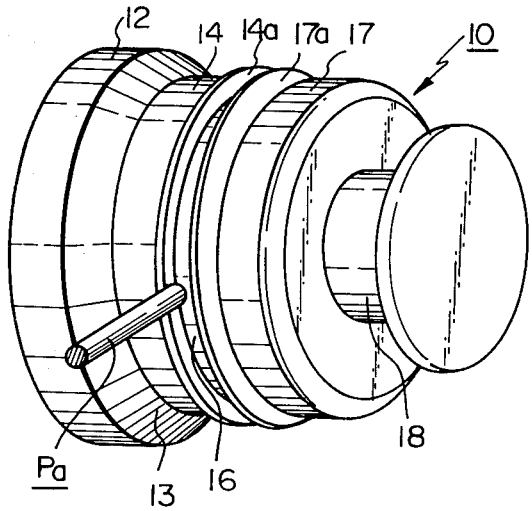
FIG. 1 is a perspective view of the weft reserving drum used for the first embodiment of the weft reservoir in accordance with the present invention.

In the following description, parts belonging to different embodiments but substantially common in construction and operation are designated with common reference numerals and symbols.

Since the present invention concerns a weft reservoir of an alternate two-picks change type wherein a weft is supplied continuously, the reservoir is naturally provided with a pair of weft reserving drums 1, a pair of weft metering devices 2, a pair of weft air blowers 3, a pair of eyelets 4 for guiding the weft 5, a pair of weft grippers 6 and a pair of weft insertion nozzles 7. These weft reserving drums, however, are quite similar in construction and operation except for a prescribed operational timing. Consequently for conveniency in description, the following explanation will be made to one of the pair of weft reserving drums.

Figure 2:
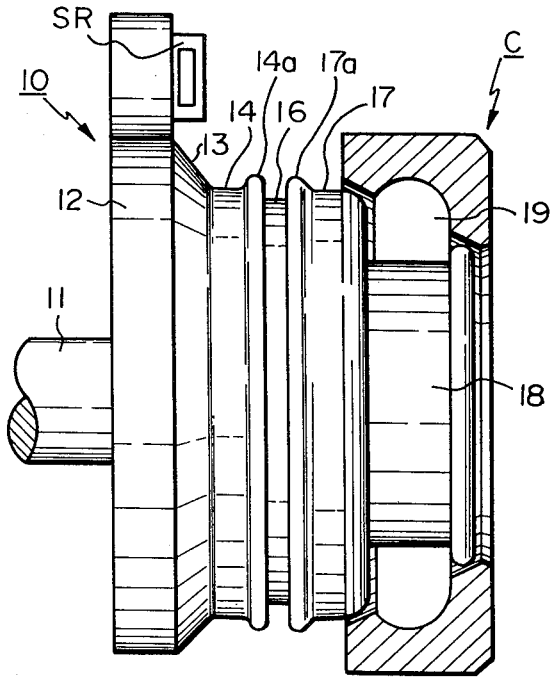
FIG. 2 is a side view, partly in section, of the weft reservoir including the weft reserving drum shown in FIG. 1.

One embodiment of the weft reserving drum in accordance with the present invention is shown in FIGS. 1 and 2, in which the weft reserving drum 10 is accompanied with a fixed cover C, a weft control pin Pa operable on the weft being wound on the reserving drum 10 as hereinafter described in more detail, and a mechanism (not shown) for controlling the operation of the weft control pin Pa. An additional mechanism should preferably be annexed to the weft reserving drum for adjusting the peripheral angular position of the weft control pin Pa with respect to the weft reserving drum 10 in accordance with change in length of the weft to be inserted which is usually caused by change in weaving width.

The weft reserving drum 10 is made up of several cylindrical and conical sections arranged in axial alignment. At a position remotest from a weft ejection nozzle (not shown) of the loom a cylindrical driver section 12 is arranged around a main shaft 11 in peripheral pressure contact with a measuring roller in order to drive the latter for rotation. The driver section 12 merges into a conical weft guide section 13 converging towards the nozzle side. The conical guide section 13 is then followed by a cylindrical weft reserving section 14, whose diameter is smaller than that of the driver section 12. This section 14 is hereinafter referred to "the first weft reserving section". A like weft reserving section 17 is mounted around the main shaft 11, whose diameter is substantially similar to that of the first weft reserving section 14. This section 17 is hereinafter referred to "the second weft reserving section". A cylindrical section 16 is formed in between the first and second weft reserving sections 14 and 17, whose diameter is somewhat smaller than those of the two sections 14 and 17. This section is referred to "the annular groove section". Ends of the first and second weft reserving sections 14 and 17 mating the annular groove section 16 are provided with small flanges 14*a* and 17*a* for later-described smooth transit of the weft. At a position closest to the nozzle, a cylindrical section 18 is secured at its boss (not shown) to the main shaft 11 coupled to a given drive source (not shown), whose diameter is smaller than those of the reserving sections 14 and 17. This section is hereinafter referred to "the holder section". The above-described six sections 12 through 18 are formed in one body and rotatable together as the main shaft 11 is driven for rotation.

The cover C embraces a part of the second weft reserving section 17 and the holder section 18 leaving a small gap whilst defining an annular air passage 19 around the holder section 18. The air passage 19 communicates with the outside atmosphere via an end opening of the cover C. As in the known drum type weft reservoirs, air supplied by a given source (not shown) flows through the air passage in the same direction as the rotating direction of the weft reserving drum 10.

The control pin Pa is located at a position corresponding to the annular groove section 16 of the weft reserving drum 10 and, at prescribed timings, advances into and recedes out of the annular groove section 16 by operation of a control mechanism (not shown) including a cam and links which operate in synchronism with running of the loom.

Figure 3:
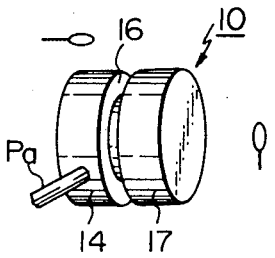
FIG. 3 is a simplified illustration of the weft reservoir shown in FIG. 2.

Sequential operation of the weft reservoir in accordance with the present invention will hereinafter be explained in detail in reference to FIGS. 4 and 5A through 5I. In connection with this, the construction of the weft reserving drum 10 is simplified in these drawings as shown in FIG. 3 for easy understanding of the operation.

Figure 4:
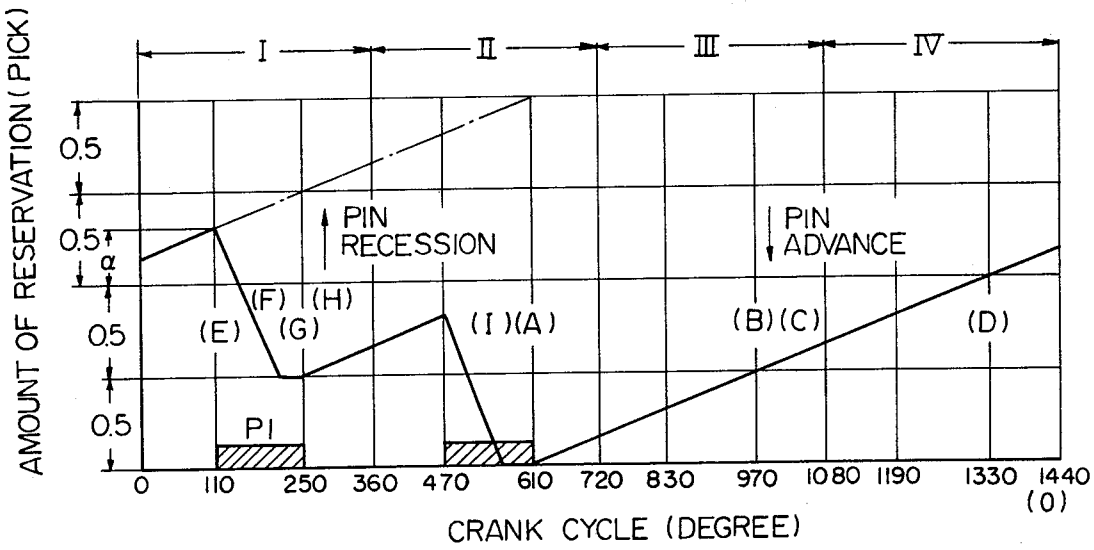
FIG. 4 is an operation diagram for the weft reservoir shown in FIG. 2, FIGS. 5A to 5I are perspective views for showing the operation of the weft reservoir of the first embodiment.

As shown in FIG. 4, one complete operation cycle of the weft reservoir in accordance with the present invention spans four crank cycles I through IV of the loom, i.e. 1440° crank angles. For conveniency in explanation, particular timings are set for weft insertion and operation of the control pin in the following description. In application of the present invention, however, these timings can be conditionally changed as desired.

It is assumed that the weft reserving drum 10 reserves the length of weft W for half a pick during one crank cycle of the loom.

Figure 5A:
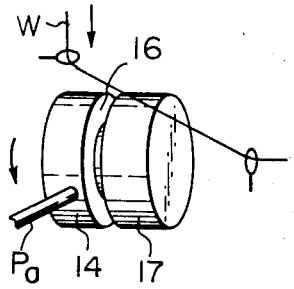

FIG. 5A depicts the condition of the weft reserving drum 10 at a timing A in FIG. 4, i.e. at 610° crank angle when the second weft insertion has just been completed. At this timing A, the control pin Pa recedes out of the annular groove section 16 of the drum 10 and rests at its inoperative position. No weft is yet reserved on the drum 10. Since the weft W is supplied continuously from an upstream supply source (not shown), the weft W is reserved on the first weft reserving section 14 of the drum 10 at a rate of 0.5 picks/360° crank angles as the loom goes on running. Since no insertion of weft is carried out during this period, no weft is delivered from the reserving drum 10. Consequently, the length of weft reserved on the drum 10 increases gradually as shown in FIG. 4.

Figure 5B:
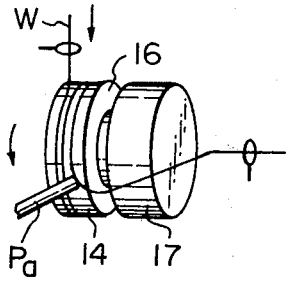

FIG. 5B depicts the condition of the weft reserving drum at a timing B in FIG. 4, i.e. at 970° crank angle. At this moment, the length of weft for half a pick has already been wound about and reserved on the first weft reserving section 14 of the drum 10. Delivery of weft, i.e. the first weft insertion, from the other weft reserving drum starts at 830° crank angle and terminates at the timing B, i.e. 1190.

At an appropriate timing somewhat after the timing B, i.e. at a timing after 970° crank angle but before the next wind of weft comes to the position of the control pin Pa, the control pin Pa is driven for advance into the annular groove section 16 of the drum 10 in order to be registered at its operative position. Due to the presence of the control pin Pa and the rotation of the reserving drum 10, the weft W is handed over to the second weft reserving section 17 astriding the control pin Pa and starts to be wound about and reserved on the second weft reserving section 17 of the drum 10. The angular position of the control pin Pa with respect to the reserving drum 10 is fixed so that the angular position corresponds to a peripheral position on the drum 10 whereat the length of weft for half a pick has just been reserved on the first weft reserving section 14 as shown in FIG. 5B.

The length of weft for one pick varies in accordance with the weaving width on the loom whereas the total peripheral length of each weft reserving section is constant once the diameter of the drum 10 is fixed. In order to cover this gap, the angular position of the control pin Pa should preferably be changeable along the periphery of the weft reserving drum in order to freely adjust the winding angle of the weft W on the drum 10.

Figure 5C:
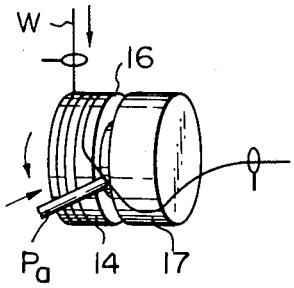

FIG. 5C depicts the condition of the weft reserving drum 10 at a timing C in FIG. 4, i.e. at a moment just after the transit of the weft W to the second reserving section 17.

Figure 5D:
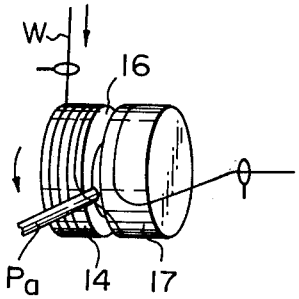

Running of the loom and weft reservation on the drum further continue. At a timing D in FIG. 4, the length of weft for half a pick has already been wound about and reserved on the second weft reserving section 17. More precisely, a part of the above-describe length is still on the first weft reserving section 14. This condition is illustrated in FIG. 5D. Meanwhile, delivery of weft for the second weft insertion is carried out on the other weft reserving drum during the period of 1190° to 1330° crank angle.

Figure 5E:
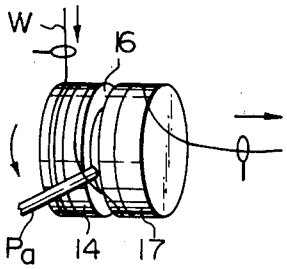

Since weft insertion is not yet started, winding and reservation of the weft W continue on the second weft reserving section 17 untill a timing E in FIG. 4, i.e. 110° crank angle. That is, during the period between timings D and E, a surplus of weft for 2 pick $$\left(=\frac{0.5}{360}\times 220\right)$$

is wound about and reserved on the second weft reserving section 17. Consequently, the length of weft for $(1+\alpha)$ pick has been reserved on the drum at the timing E. That is, the first reserving section 14 carries the length of weft for half a pick and the second reserving section 17 carries the length of weft for $(0.5+\alpha)$ pick. The condition of the weft reserving drum 10 at the timing E is shown in FIG. 5E.

Figures 5F, 5G:
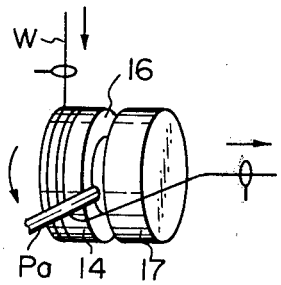

The first weft insertion starts at the timing E and the length of weft for $(0.5+\alpha)$ pick on the second weft reserving section 17 is delivered. Since there is no particular resistance against this delivery of the weft W, the free delivery shown in FIG. 6 is carried out here. As the weft W on the second weft reserving section 17 has been fully delivered, the weft W now runs under the control pin Pa due to the presence of the control pin Pa and the continued rotation of the weft reserving drum 10. This condition is shown in FIG. 5F. Since the position of the control pin Pa is fixed under this condition, the length of weft W reserved on the first weft reserving section 14 is delivered therefrom, the weft delivery speed being equal to the weft measuring speed during the period from the timing F to 250° crank angle. The delivery speed of the weft W from the drum 10, i.e. the first weft reserving section 14, during this period is by far smaller than that during the free delivery. Controlled delivery of weft shown in FIG. 6 continues during the period from the timing F to a timing G. The timing F is somewhat ahead of the timing G where at the first weft insertion terminates.

At the timing G, i.e. at 250° crank angle, the length of weft for one pick has already been delivered from the drum 10. During the first weft insertion period P1, the weft W taken from the supply source is concurrently wound about and reserved on the first weft reserving section 14 of the drum 10. Imaginary increase in amount of weft reserved on the drum 10 is shown with a chain line in FIG. 4, if weft insertions were not carried out. In practice, however, weft insertions are carried out twice each accompanying concurrent delivery of the length of weft for one pick, and the amount of weft reserved on the drum 10 shifts as shown with solid lines. FIG. 5G depicts the condition of the weft reserving drum 10 when the first weft insertion terminates.

Delivery of the weft W from the drum 10 ceases at the timing G but the supply of the weft W from the source continues. Consequently, the weft W is wound about and reserved on the first weft reserving section 14 and the amount of the weft W reserved on the drum 10 starts to increase. At an appropriate timing after the timing G, i.e. at a timing after 250° crank angle but before the next wind of weft comes to the position of the control pin Pa, the control pin Pa is driven for recession out of the annular groove section 16 of the drum 10 in order to resume its inoperative position. This condition is shown in FIG. 5H.

The second weft insertion starts at 470° crank angle and the weft W is delivered again so that the amount of the weft W reserved on the drum 10 decreases. This weft delivery is the free delivery since the weft W is taken from the first weft reserving section 14. At a timing I somewhat ahead of termination of the second weft insertion at 610° crank angle, the weft W is conducted to the ejection nozzle directly from a supply roller SR of the supply source. The controlled delivery of weft starts at this moment under influence by the supply speed of the roller SR. The condition of the weft reserving drum 10 at the timing I is shown in FIG. 5I. This controlled delivery of weft lasts untill the timing A in FIG. 4.

At the timing A, i.e. at 610° crank angle, the second weft insertion terminates the drum 10 is placed under the condition shown in FIG. 5A in order to sequencially repeat the operations shown in FIGS. 5A through 5I.

As is clear from the foregoing, the combination of the control pin with the annular groove section on the drum 10 in accordance with the present invention enables reliable practice of the controlled delivery of weft even on a reserving drum type weft reservoir where the weft is continuously supplied from the given supply source, thereby assuring constant production of woven cloths with reduced loss of weft.

In the case of the above-described first embodiment of the present invention, the weft reserving drum 10 is provided with two weft reserving sections. The present invention, however, is not limited to this construction. In a modified second embodiment of the present invention, a weft reserving drum is provided with one weft reserving section only.

Figure 8:
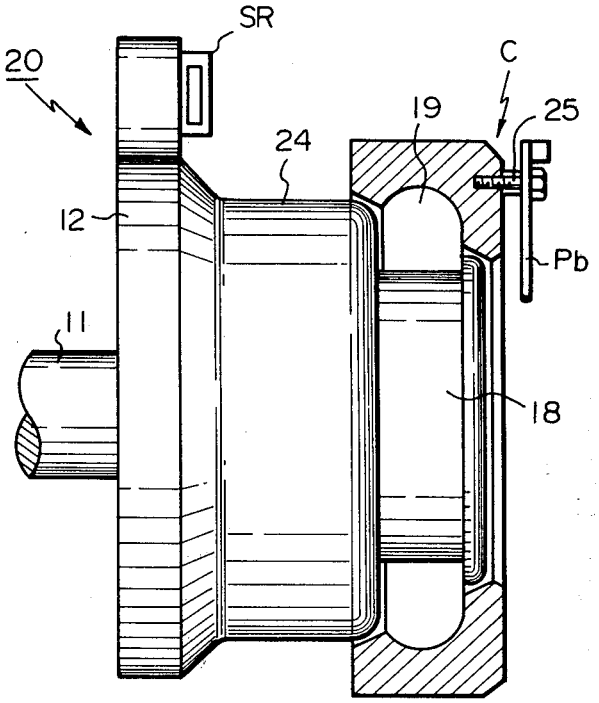
FIG. 8 is a side view, partly in section, of the weft reservoir including the weft reserving drum shown in FIG. 7.

Such a weft reserving frum 20 is shown in FIGS. 7 and 8, in which the drum 20 is provided, just like the drum 10 of the first embodiment, with the cylindrical driver section 12, the conical weft guide section 13 and the cylindrical holder section 18 fixed on the main shaft 11. A further cylindrical section 24 is formed between the weft guide and holder sections 13 and 18. The diameter of this intermediate section 24 is somewhat smaller than that of the driver section 13. This section 24 is hereinafter referred to "weft reserving section".

A control pin Pb is disposed to the outlet side end face of the cover C by means of a shaft 25 fixed to the end face. Like the control pin Pa used for the first embodiment, this pin Pb is operationally coupled to a mechanism for controlling its operation, and swingable in a plane normal to the axis of the drum 20.

Figure 9:
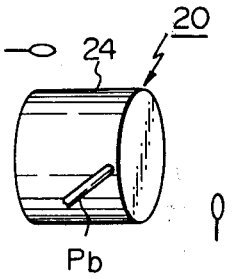
FIG. 9 is a simplified illustration of the weft reservoir shown in FIG. 8.

Sequential operation of the weft reservoir of this second embodiment of the present invention will hereinafter be explained in detail in reference to FIGS. 11A through 11H. In connection with this, the construction of the weft reserving drum is simplified in the drawings as shown in FIG. 9 for easy understanding of the operation.

Figure 11A:
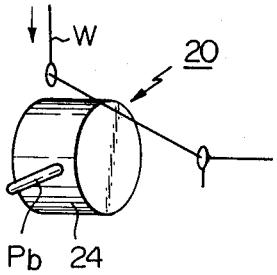

FIG. 11A depicts the condition of the weft reserving drum 20 at a timing A, i.e. at 610° crank angle whereat the second weft insertion has been completed. At this timing A, the control Pb is placed in its inoperative position out of engagement with the weft W, and no weft is reserved on the drum 20. Since the weft W is continuously supplied, the weft W is wound about and reserved on the weft reserving section 24 at a rate of 0.5 picks/360° crank angles as the loom goes on running. No weft insertion takes place during this period and, consequently, the weft W on the reserving section 24 of the drum 20 gradually increases in amount. At a timing B, the control pin Pb is driven for swinging about the shaft 25 by the above-described control mechanism in order to be registered at its operative position. At this operative position, the point of the control pin Pb is located in front of the outlet opening the cover C and brought into engagement with the weft W unwound from the weft reserving section 24 of the drum.

Figure 11B:
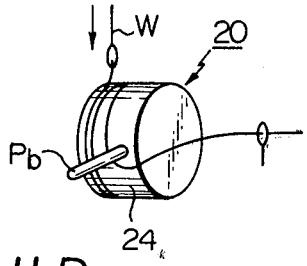

The condition of the drum 20 at a timing B, i.e. at 970° crank angle, is shown in FIG. 11B. No weft insertion is initiated at this moment as yet and the length of weft for half a pick has already been reserved on the reserving section 24 of the drum 20. Delivery of weft from the other weft reserving drum, i.e. the first weft insertion, starts at 830° crank angle and terminates at the timing B, i.e. at 970° crank angle.

Figure 11C:
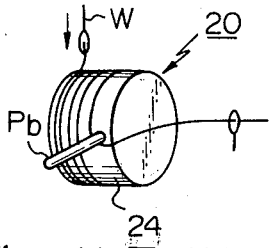

The drum 20 is placed under the condition shown in FIG. 11C at a timing C, i.e. at 1330° crank angle. No weft insertion is initiated at this moment as yet and the length of weft for one pick has been reserved on the reserving section 24 of the drum 20. Incidently, delivery of weft from the other weft reserving drum, i.e. the second weft insertion, starts at 1190° crank angle and terminates at the timing C, i.e. at 1330° crank angle.

Figure 11D:
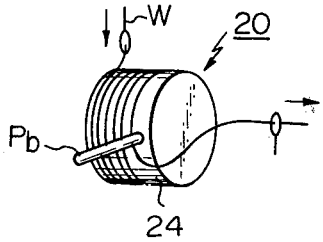
Figure 11:
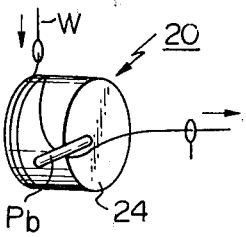
Figure 11G:
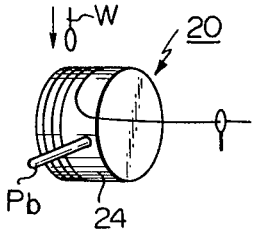

Reservation of weft on the drum 20 further goes on during the period from the timing C to a timing D, i.e. to 110° crank angle. During this period, the length of weft for $\alpha$ pick $$\left(= 0.5 \times \frac{220}{360}\right)$$

is further reserved on the weft reserving drum 20. Therefore at this moment, the length of weft for $(1+\alpha)$ picks has already been reserved on the drum 20. This condition is shown in FIG. 11D.

The first weft insertion starts at the timing D and the reserved weft is delivered from the drum 20 while new weft taken from the source is concurrently wound about and reserved on the drum 20. Since the length of weft for $(1+\alpha)$ picks has already been reserved on the drum 20, the weft W is subjected to the free delivery in FIG. 6.

Figure 10:
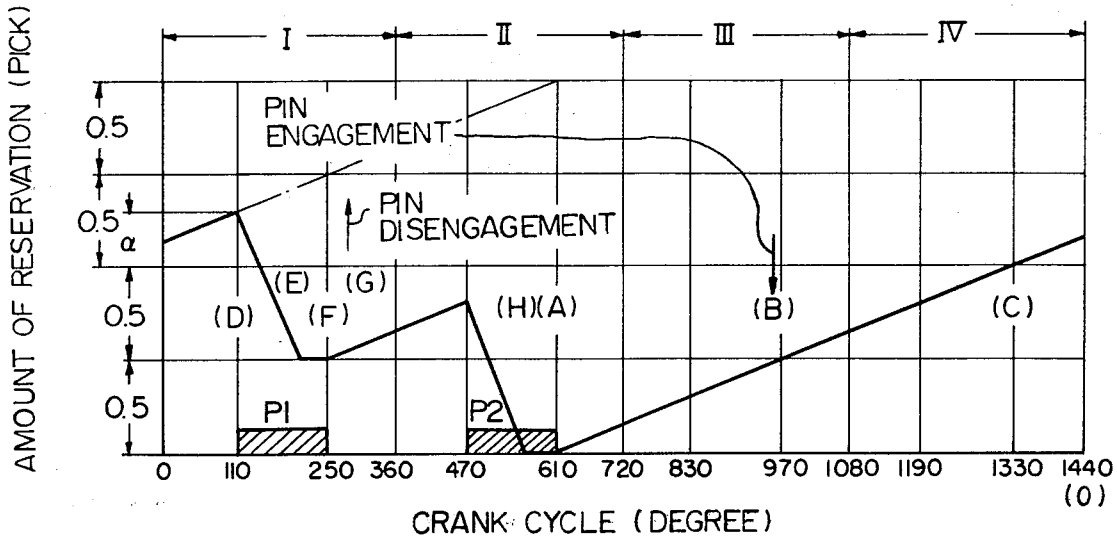
FIG. 10 is an operation diagram for the weft reservoir shown in FIG. 8, FIGS. 11A to 11H are perspective views for showing the operation of the weft reservoir of the second embodiment.

As the weft W on the weft reserving section 24 of the drum has been fully delivered, the weft W now runs under the control pin Pb due to the presence of the control pin Pb and the continued rotation of the weft reserving drum 20. This condition is shown in FIG. 10E.

Thus, the weft W is delivered from the drum 20 whilst being kept in engagement with the control pin Pb placed in the operative position. This delivery speed is equal to the weft measuring speed. The weft W is now subjected to the controlled delivery in FIG. 6. The condition of the weft reserving drum 20 is shown in FIGS. 11E and 11F. This timing E is somewhat ahead of a timing F whereat the first weft insertion terminates.

By the timing F whereat the first weft insertion terminates, the length of weft for one pick has been delivered from the weft reserving drum 20. During this weft insertion period P1, the weft W taken from the source is wound about and reserved on the weft reserving section 24 of the drum 20. Imaginary increase in amount of weft reserved on the drum 20 is shown with a chain line in FIG. 10, if weft insertions were not carried out. In practice, however, weft insertions are carried out twice each causing concurrent delivery of the length of weft for one pick, and the amount of weft reserved on the drum 20 shifts as shown with solid lines.

Delivery of weft from the drum 20 terminates at the timing F and supply of the weft W from the source continues. Thus, the amount of weft reserved on the drum 20 again increases. The control pin Pb is driven by swinging back to its initial inoperative position by the above-described control mechanism at an appropriate timing G, more specifically at a timing after completion of the first weft insertion but before the next wind of weft comes to the position of the control pin Pb. At this inoperative position, the control pin Pb is out of engagement with the weft W to be unwound from the weft reserving drum 20.

Figure 11H:
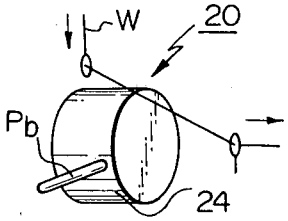

The second weft insertion starts at 470° crank angle, the weft W reserved on the drum 20 is again delivered and the amount of weft on the drum 20 accordingly decreases. The weft W is here subjected to the free delivery shown in FIG. 6. At a timing H just ahead of termination of the weft insertion at 610° crank angle, the weft W starts to be delivered directly from the supply roller SR of the source and, due to influence of the weft supply speed, subjected to the controlled delivery shown in FIG. 6, which lasts until the timing A. The condition of the weft reserving drum 20 at the timing H is shown in FIG. 11H.

The second weft insertion terminates at the timing A and the weft reserving drum 20 resumes the condition shown in FIG. 11A in order to repeate the above-described operations as shown in FIGS. 11A through 11H.

As long as the control pin Pb is engageable with the weft W in its operative position and placed out of such an engagement in its inoperative position, the control pin Pb may be disposed to any body other than the cover C. It is also employable in the present invention that, during the second weft insertion, the control pin Pb is driven for engagement with the weft W to be unwound from the weft reserving drum.

In connection with the first embodiment of the present invention in which the drum includes first and second cylindrical weft reserving sections in axial alignment, a wide variety of modifications are employable.

Figure 12:
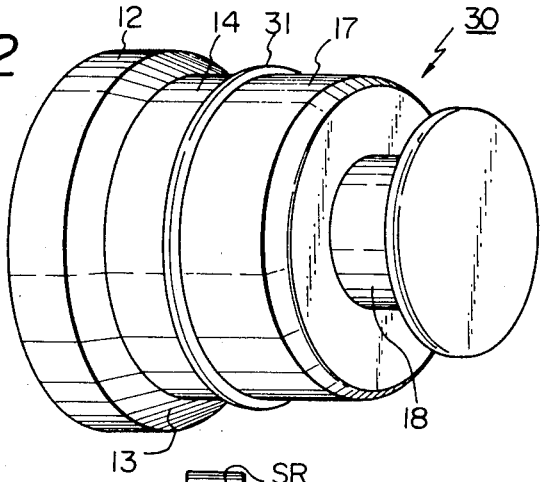
FIG. 12 is a perspective view of the weft reserving drum used for the third embodiment of the weft reservoir in accordance with the present invention.
Figure 13:
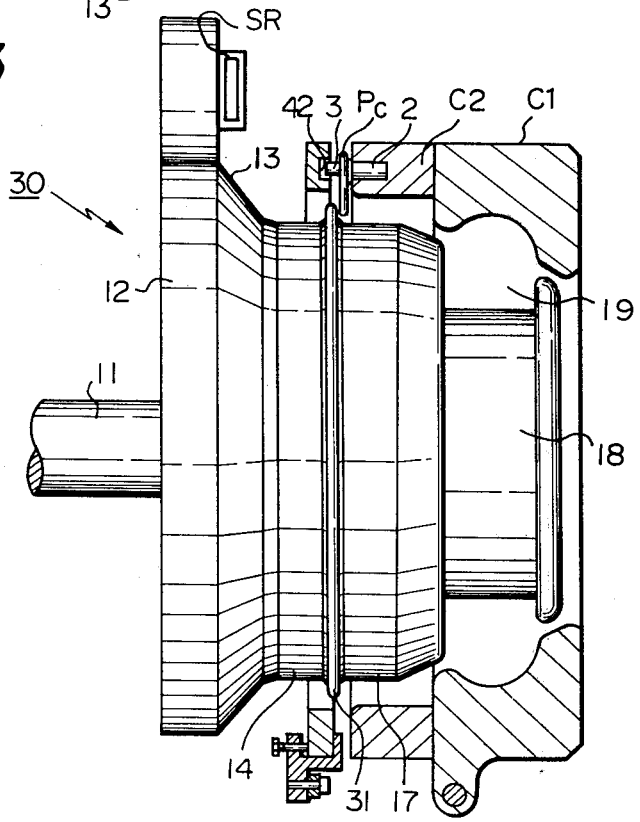
FIG. 13 is a side view, partly in section, of the weft reservoir including the weft reserving drum shown in FIG. 12.

One of such a modification is shown in FIGS. 12 and 13, in which an annular projection delimits the first and second weft reserving sections as a substitute for the annular groove section in the first embodiment.

In FIGS. 12 and 13, a weft reserving drum 30 is accompanied with fixed covers C1 and C2 combined in axial alignment, a ring assembly 40 coaxially rotatable about the drum 30, a control pin Pc disposed to the cover C2 and a control mechanism (not shown) for driving the ring assembly 40 for turning.

The first cover C1 is mounted to a horizontal shaft 1 fixed to a framework (not shown) of the loom. When necessary, the cover C1 is turnable about the shaft 1 which extends normal to the axial direction of the weft reserving drum 30. The second cover C2 is axially turnable relative to the first cover C1 in order to shift the angular position of the control pin Pc along the periphery of the weft reserving drum 30 in accordance with change in weaving width. The ring assembly 40 is also axially turnable together with the second cover C2. To this end, the ring assembly 40 is accompanied with a driver rod 41 (see FIG. 14) coupled to a suitable drive source (not shown).

The control pin Pc has a shaft 2 axially rotatably received in a hole formed in the end face of the second cover C2. The control pin Pc is further provided with a projection 3 idly received in a skew groove 42 formed in the end face of the ring assembly 40.

As shown in FIG. 12, the weft reserving drum 30 includes the cylindrical driver section 12, the conical weft guide section 13, the cylindrical first weft reserving section 14, the cylindrical second weft reserving section 17, the cylindrical holder section 18, the main shaft 11 and an annular projection 31 delimitting the first and second weft reserving sections 14 and 17. The fixed cover C1 defines the air passage 19 around the holder section 18 of the drum 30.

The control pin Pc is arranged on the second cover C2 at a position corresponding to the position of the annular projection 31 on the drum 30. As the ring assembly 40 is driven for axial turning by movement of the driver rod 41, the projection 3 swings about the shaft 2 held by the second cover C2 whilst being guided by the skew groove 42 formed in the ring assembly 40. Consequently, the control pin Pc swings about the shaft 2 also since the projection 3 is formed in one body with the control pin Pc. This movement of the control pin Pc is shown in FIG. 14.

Figure 14:
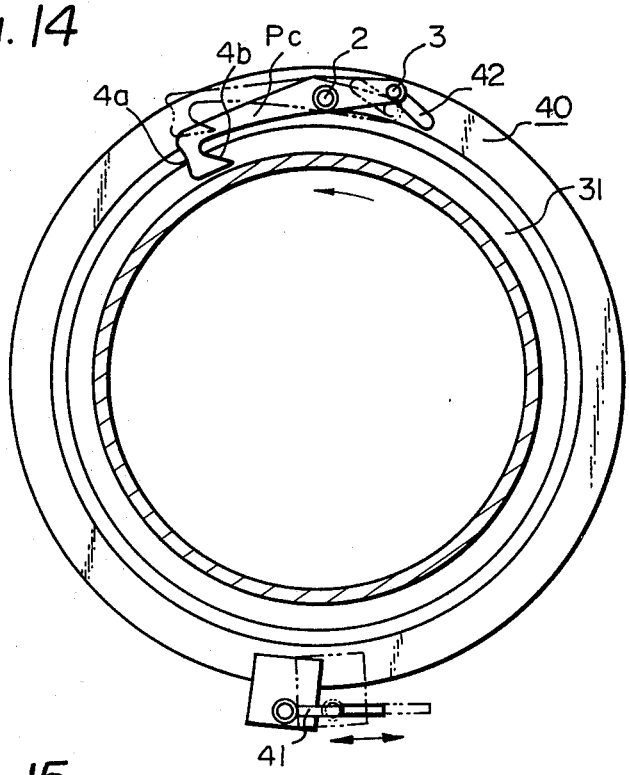
FIG. 14 is a diametral cross sectional view of the weft reservoir shown in FIG. 13.

In the position shown with solid lines in FIG. 14, the hooked point of the control pin Pc is located near the base of the annular projection 31 on the drum 30. Whereas, in the position shown with chain lines in FIG. 14, the hooked point of the control pin Pc is located above the top of the annular projection 31.

The control pin Pc is provided at its hooked point with a hollow nose **4*a* and a hook 4*b*** both adapted for engagement with the weft.

When the weft W is handed over from first to second weft reserving section passing over the annular projection 31, the weft W is caught by the hook **4*b* of the control pin Pc. Due to the relatively small crossing angle of the weft W with the annular projection 31 at this transit, the weft W is liable to fall off the hook 4*b* of the control pin Pc. In order to prevent this accident, the hook 4*b* is deeply constructed. The point of the hook 4*a*** converges forwards for engagement of the weft W with the control pin Pc in the lowered position (solid lines) i.e. the operative position.

During the controlled delivery shown in FIG. 6, the weft W comes into engagement with the hollow nose **4*a* of the control pin Pc. In this case, the crossing angle of the weft W with the annular projection 31 of the drum 30 and, therefore, the weft W does not fall off the nose 4*a* despite its relatively shallow hollowness. This shallow construction of the hollow nose 4*a*** enables easy disengagement of the weft W with the control pin Pc moving upwards.

In the foregoing description, the weft reserving drum 30 is assumed to rotate in the direction shown with an arrow in FIG. 14, i.e. in the counterclockwise direction. When the weft reserving drum 30 rotates in the opposite direction, the hollow nose **4*a* should be deeper in construction whereas the hook 4*a*** should have a shallower construction.

The sequential operation of the weft reservoir of this embodiment is substantially same as that of the first embodiment and the timing diagram for the first embodiment given in FIG. 4 is applicable to this embodiment. At the timing H, the control pin Pc rises towards the inoperative position and lower towards the operative position at a timing just after the timing B.

Figure 15:
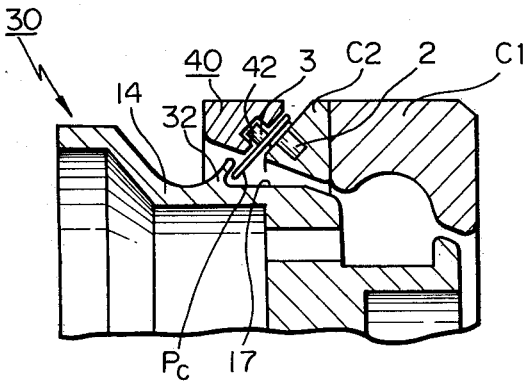
FIG. 15 is a fragmentary side sectional view of a modification of the third embodiment shown in FIG. 13.
Figure 16:
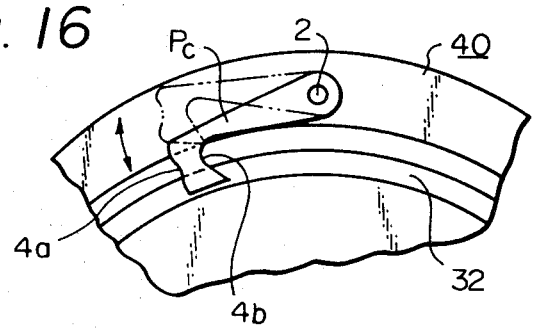
FIG. 16 is an end view of the arrangement shown in FIG. 15.

A further modification is shown in FIGS. 15 and 16, in which the weft reserving drum 30 is provided with an overhand type annular projection 32 inclining towards the nozzle side and the hooked point of the control pin Pc extends somewhat under the annular projection 32. The inclined overhang construction of the annular projection 32 assures successful engagement of the weft W with the control pin Pc. Like the foregoing embodiment, the control pin Pc is held by the second cover C2 by means of the shaft 2 and provided with the projection 3 received in the skew groove 42 in the ring assembly 40.

In the case of the foregoing embodiments each having an annular projection, respectively, the control pin Pc is located on the nozzle side of the annular projection. The control pin may, however, be arranged on the opposite side of the annular projection. In this case, the overhang type annular projection should be inclined over the hooked point of the control pin.

In the case of the foregoing embodiments in which a weft reserving drum is provided with a pair of weft reserving sections in axial alignment, the two weft reserving sections are driven for rotation at an equal rotation speed by a common main shaft. In connection with this, however, the pair of weft reserving sections may be rotated at different rotation speeds in a further modified embodiment of the present invention.

In accordance with the third embodiment of the present invention, the weft reservoir is provided with a pair of weft reserving drums in axial alignment. The pair of weft reserving drums are driven for rotation at different rotation speeds. That is, the peripheral speed of the second weft reserving drum closer to the nozzle is equal to or larger than that of the first weft reserving drum closer to the supply source of weft. A control pin is arranged facing the border between the two weft reserving drums.

The first weft reserving drum corresponds to the above-described first weft reserving section whereas the second weft reserving drum corresponds to the above-described second weft reserving section.

Prescribed movement of the control pin causes transit of the weft from the first to the second weft reserving drum and engagement of the control pin with the weft during weft insertion enables controlled delivery of the weft.

Difference in peripheral speed between the two weft reserving drums well avoids slack of weft at transit from the first to the second drum. Difference in diameter between the drums assures reliable engagement of the control pin with the weft in order to enable smooth transit and the controlled delivery of the weft.

Figure 17:
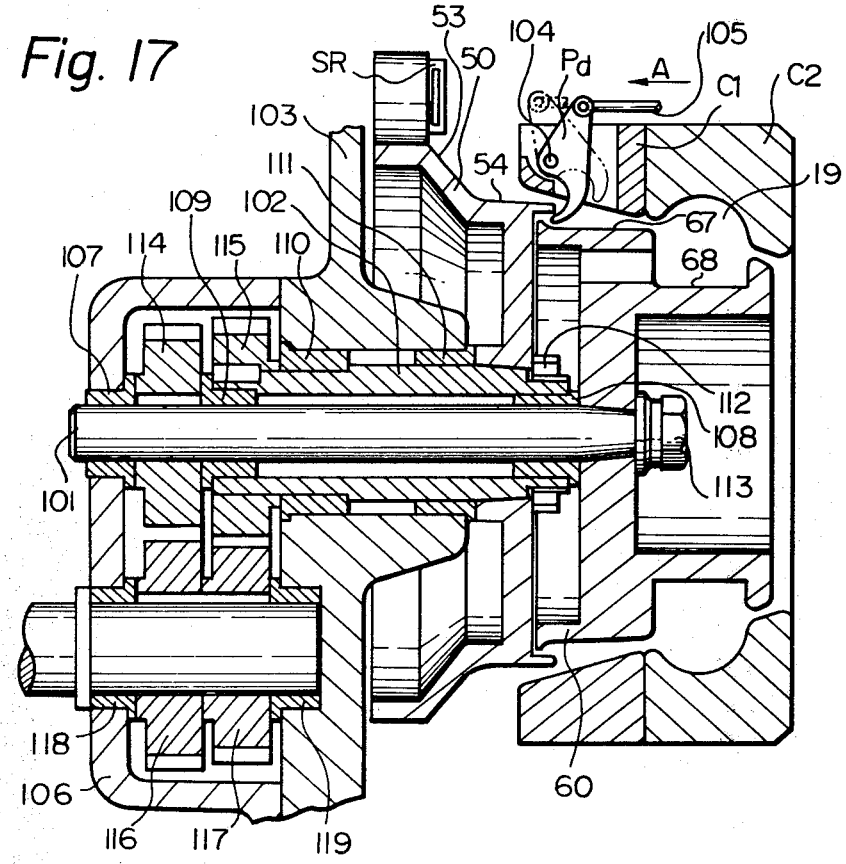
FIG. 17 is a side view, partly in section, of the fourth embodiment of the weft reservoir in accordance with the present invention.
Figure 18:
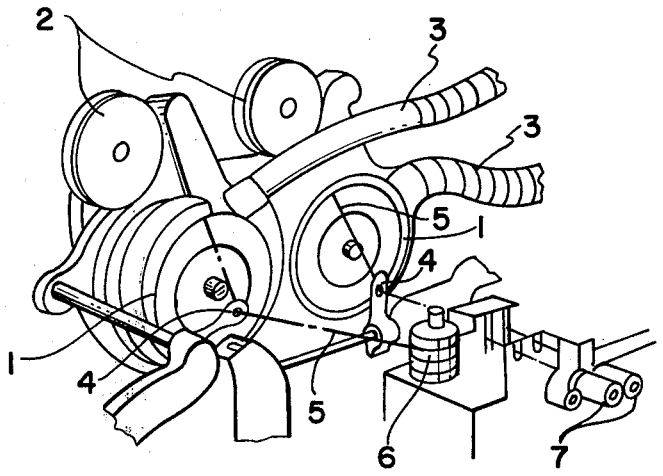
FIG. 18 is a perspective view showing the weft reservoir adapted for operation with an alternate two-picks change type fluid jet loom having two reserving drums in accordance with the present invention.

Such further embodiment of the present invention is shown in FIG. 17, in which the weft reservoir is provided with a pair of weft reserving drums 50 and 60 in axial alignment.

The first weft reserving drum 50 is provided, in axial alignment, with a cylindrical driver section 52 for pressure contact with the supply roller SR, a conical weft guide section 53 following the driver section 52 and a cylindrical weft reserving section 54, in one body with each other. The reserving section 54 is smaller in diameter than the driver section 52.

The second weft reserving drum 60 is provided, in axial alignment, with a cylindrical weft reserving section 67 and a cylindrical holder section 68.

The weft reserving section 54 of the first drum 50 is larger in diameter than the weft reserving section 67 of the second drum 60.

The first drum 50 is fixed to a cylindrical shaft 102 whereas the second drum 60 is fixed to an auxiliary shaft 101 extending coaxially through the cylindrical shaft 102. First and second covers C1 and C2 are mounted, in axial alignment, to a framework 103 of the weft reservoir whilst covering the first and second weft reserving drums 50 and 60 in order to define the air passage 19 around the holder section 68 of the second drum 60. The first cover C1 is axially turnable about the second cover C2 so that the angular position of a control pin Pd, which is carried by the first cover, is shiftable along the periphery of the second drum 60 in accordance with change in weaving width on the loom.

The control pin Pd is swingably mounted to the first cover C1 by means of a horizontal pivot pin 104 fixed to the first cover C1 whilst extending substantially normal to the axial direction of the weft reservoir. The control pin Pd is driven for swinging by a rod 105 which reciprocates axially at prescribed timings in synchronism with running of the loom. This control pin Pd is adapted for provisional engagement with the weft W taken from the supply source at prescribed timings in order to assist transit of the weft W from the first to the second weft reserving drum. The control pin Pd further causes the control delivery shown in FIG. 6 by its provisional engagement with the weft W unwound freely from the second drum 60. When the rod 105 assumes the position shown with solid lines in FIG. 17, the control pin Pd is kept in engagement with the weft W. As the rod 105 shifts in the direction shown with an arrow A, the control pin Pd assumes the position shown with chain lines and is brought out of engagement with the weft W. In the inoperative position, the control pin Pd is almost fully accommodated within the first cover C1.

The auxiliary shaft 101 is rotatably supported by a gear casing 106 fixed to the framework 103 and the cylindrical shaft 102 by means of bearings 107, 108 and 109. Whereas the cylindrical shaft 102 is rotatably supported by the framework 103 by means of bearings 110 and 111. The first weft reserving drum 50 is fixed to the cylindrical shaft 102 by a fastening nut 112 whereas the second weft reserving drum 60 is fixed to the auxiliary shaft 101 by a fastening nut 113.

In the gear casing 106, a gear 114 is fixed to the auxiliary shaft 101 and a gear 115 is fixed to the cylindrical shaft 102, the gears 114 and 115 being somewhat spaced from each other in the axial direction of the weft reservoir. The gears 114 and 115 and in meshing engagement with gears 116 and 117 fixed to the main shaft 11, respectively. Consequently, rotation of the main shaft 11 is transmitted on the one hand to the second weft reserving drum 60 via the gears 116, 114 and the shaft 101 and, on the other hand, to the first weft reserving drum 50 via the gears 117, 115 and the shaft 102.

The gear ratios between the gears 116 and 114, and between the gears 117 and 115 are designed in the case of this embodiment so that the peripheral speed of the second drum 60 is equal to or larger than that of the first drum 50. Bearings 118 and 119 are arranged for rotatable coupling of the main shaft 11 with the gear casing 106 and the framework 103.

Operation of this embodiment is substantially similar to that of the first embodiment and its operation diagram is substantially similar to that shown in FIG. 4.

As long as the above-described relationship in peripheral speed is satisfied, the relationship in diameter between the two drums may be reversed.

I claim:

1. Weft reservoir adapted for controlling the rate of insertion of weft in an alternate two-pick change type fluid jet shuttleless loom comprising, a weft reserving drum assembly arranged between a weft supply source and a jet nozzle of said loom, means for driving said weft reserving drum assembly in continuous axial rotation, means for continuously supplying a weft from said supply source to said weft reserving drum assembly, a weft control pin arranged adjacent said weft reserving drum assembly adapted for controlling the rate of the terminal stage during the insertion of said weft, and means for registering said weft control at prescribed timings during the rotation of said weft reserving drum assembly into an operative position whereat said weft control pin is placed in provisional engagement with said weft and into an inoperative position whereat said weft control pin is placed out of said provisional engagement with said weft, whereby said weft is initially inserted at a free delivery rate and thereafter terminally inserted at a controlled rate while said weft control pin is registered in said operative position in provisional engagement with said weft.

2. Weft reservoir as claimed in claim 1 in which
the angular position of said weft control pin is shiftable along the periphery of said weft reserving drum assembly.

3. Weft reservoir as claimed in claim 1 further comprising
a cover assembly covering at least the nozzle side end section of said weft reserving drum assembly in order to define an air passage around said nozzle side end, said air passage opening on its nozzle side end, and
means for supplying air into said air passage in a direction the same as the rotating direction of said weft reserving drum assembly.

4. Weft reservoir claimed in claim 3 in which
said weft reserving drum assembly includes a weft reserving drum.

5. Weft reservoir claimed in claim 4 in which
said weft reserving drum includes a pair of cylindrical weft reserving sections in axial alignment, and
said weft control pin is located facing the border between said pair of weft reserving cylindrical sections.

6. Weft reservoir as claimed in claim 5 in which
an annular groove delimits said pair of weft reserving sections,
the point of said control pin is placed in said annular groove when said control pin is registered at said operative position, and
said point of said control pin is placed out of said annular groove when said control pin is registered at said inoperative position.

7. Weft reservoir as claimed in claim 6 in which
said annular groove is provided on either sides with small flanges.

8. Weft reservoir as claimed in claim 5 in which
an annular projection delimits said pair of weft reserving sections,
the point of said control pin is placed close to the base of said annular projection when said control pin is registered at said operative position, and
said point of said control pin is placed above the top of said annular projection when said control pin is registered at said inoperative position.

9. Weft reservoir as claimed in claim 8 in which
said annular projection has an overhang construction inclining towards either side along the axis of said weft reserving drum, and
the point of said control pin is placed under said overhang construction when said control pin is in said operative position.

10. Weft reservoir as claimed in claim 8 or 9 in which said control pin registering means includes
a ring assembly coaxially arranged around said weft reserving drum and having a skew groove in its surface facing said cover assembly,
means for axially turning said ring assembly,
a shaft formed on said control pin and pivotted to said cover assembly, and
a projection formed on said control pin and idly received in said skew groove in said ring assembly.

11. Weft resevoir as claimed in claim 4 in which
said weft control pin is located facing the nozzle side end of said weft reserving drum.

12. Weft reservoir as claimed in claim 11 in which
said weft control pin is pivotted to the nozzle side end face of said cover assembly.

13. Weft reservoir as claimed in claim 3 in which
said weft drum assembly includes two weft reserving drums in axial alignment, and
said driving means drive said two weft reserving drums so that one of said reserving drums closer to said nozzle is larger in peripheral speed than another of said reserving drums.

14. Weft reservoir as claimed in claim 13 in which
the peripheral edge of the longitudinal end of one of said reserving drums mating another of said reserving drums hangs over the adjacent peripheral edge of the longitudinal end of said another of said reserving drums, and
the point of said control pin is displaceable into the gap between said peripheral edges.

* * * * *